US005915583A

United States Patent [19]

Cloonan et al.

[11] Patent Number: 5,915,583

[45] Date of Patent: Jun. 29, 1999

[54] CONTAINER

[75] Inventors: Kevin M. Cloonan, Round Lake; Ted J. Hanagan, Libertyville; Kirk M. Kimler, Grayslake, all of Ill.; Scott G. Safar, Pleasant Prairie, Wis.

[73] Assignee: Abbott Laboraties, Abbott Park, Ill.

[21] Appl. No.: 08/859,955

[22] Filed: May 21, 1997

[51] Int. Cl.[6] ..... B65D 1/42

[52] U.S. Cl. ..... 220/23.86; 220/23.87; 220/657; 220/287

[58] Field of Search ..... 220/657, 23.86, 220/23.89, 23.87, 287, 656

[56] References Cited

U.S. PATENT DOCUMENTS

| | | | |
|---|---|---|---|
| 893,469 | 7/1908 | Essmuller et al. . | |
| 2,587,221 | 2/1952 | Richardson et al. | 23/230 |
| 2,955,722 | 10/1960 | Antonious | 215/100.5 |
| 3,085,705 | 4/1963 | Varney | 215/41 |
| 3,223,269 | 12/1965 | Williams | 215/43 |
| 3,317,069 | 5/1967 | Chin | 215/47 |
| 3,606,074 | 9/1971 | Hayes | 220/42 |
| 3,607,098 | 9/1971 | Strande | 23/259 |
| 3,655,089 | 4/1972 | Tower | 220/42 |
| 3,807,457 | 4/1974 | Logsdon | 138/89 |
| 3,807,955 | 4/1974 | Note, Jr. et al. | 23/230 |
| 3,826,397 | 7/1974 | Atkins | 215/41 |
| 3,850,341 | 11/1974 | Bart | 220/212 |
| 3,980,268 | 9/1976 | Ellis | 249/49 |
| 4,055,396 | 10/1977 | Meyer et al. | 23/259 |
| 4,065,358 | 12/1977 | Kawai et al. | 195/127 |
| 4,094,641 | 6/1978 | Friswell | 23/230 |
| 4,106,907 | 8/1978 | Charlton et al. | 23/230 |
| 4,244,920 | 1/1981 | Manschot et al. | 422/102 |
| 4,278,437 | 7/1981 | Haggar | 23/230 |
| 4,310,488 | 1/1982 | Rahm et al. | 422/102 |
| 4,335,730 | 6/1982 | Griffin | 128/760 |
| 4,542,833 | 9/1985 | Devaughn | 215/319 |
| 4,583,668 | 4/1986 | Maynard, Jr. | 222/529 |
| 4,755,356 | 7/1988 | Robbins et al. | 422/102 |
| 4,761,379 | 8/1988 | Williams et al. | 435/296 |
| 4,799,599 | 1/1989 | Herrmann | 215/307 |
| 4,859,423 | 8/1989 | Perlman | 422/102 |
| 4,886,177 | 12/1989 | Foster | 215/247 |
| 4,927,605 | 5/1990 | Dorn et al. | 422/102 |
| 4,965,187 | 10/1990 | Tonelli | 435/5 |
| 4,980,293 | 12/1990 | Jeffs | 435/296 |
| 4,999,470 | 3/1991 | Fuchs, Jr. | 219/10.55 |
| 5,038,958 | 8/1991 | Dreier | 220/366 |
| 5,071,766 | 12/1991 | Barr et al. | 435/284 |
| 5,102,631 | 4/1992 | Jordan et al. | 422/42 |
| 5,139,951 | 8/1992 | Butz et al. | 435/284 |
| 5,167,929 | 12/1992 | Korf et al. | 422/102 |
| 5,169,020 | 12/1992 | Spamer | 220/287 |
| 5,180,555 | 1/1993 | Monget | 422/102 |
| 5,225,165 | 7/1993 | Perlman | 422/102 |
| 5,242,660 | 9/1993 | Hsei | 422/102 |
| 5,254,312 | 10/1993 | Staebler et al. | 422/100 |
| 5,275,299 | 1/1994 | Konrad et al. | 215/341 |
| 5,288,466 | 2/1994 | Burns | 422/102 |
| 5,377,854 | 1/1995 | Cusack | 215/364 |
| 5,377,859 | 1/1995 | Hacker | 220/287 |
| 5,384,096 | 1/1995 | Burns | 422/102 |
| 5,392,949 | 2/1995 | McKenna | 220/712 |
| 5,441,895 | 8/1995 | Jakubowicz et al. | 436/518 |
| 5,501,841 | 3/1996 | Lee et al. | 422/101 |

FOREIGN PATENT DOCUMENTS

| | | | |
|---|---|---|---|
| 0564383 | 10/1993 | European Pat. Off. | B01L 3/14 |
| 847223 | 12/1938 | France | 20/4 |

*Primary Examiner*—Joseph M. Moy
*Attorney, Agent, or Firm*—Mark C. Bach

[57] ABSTRACT

Embodiments of a container for holding an item are disclosed. In one embodiment, the container comprises an open end, a closed end and a shank connecting the open end with the closed end. A flange extends from the open end. The flange has a configuration which supports the container in an intended relationship with respect to a relatively large tube, a relatively small tube or a carrier.

1 Claim, 2 Drawing Sheets

CONTAINER

BACKGROUND

The following relates to a container and a method of using a container. More specifically, the following relates to a container and a method of using a container with an automated instrument.

Some samples, such as blood and the like, to be tested medically are collected from a patient in a tube. Some patients who are relatively healthy can afford to give a relatively large amount of sample, thereby filling the tube to a first, relatively high level. However, some patients, such as elderly people, children, people who are less healthy and the like, cannot afford to give such a relatively large amount of sample. These patients may be able to give a relatively small amount of sample which fills the tube to a second, relatively low level which is below the relatively high level reached by the sample obtained from a relatively healthy person. The second level is located on the tube such that the first level (relatively healthy person sample) is between the second level (relatively less healthy person sample) and a top or open end of the tube.

In some cases, the samples collected in the tube are presented to an automated instrument to perform medical tests on the samples. To transfer the sample from the tube to the instrument, the instrument may have a nozzle which moves into the tube and sucks a desired portion of the sample into the nozzle. If the sample in the tube were at the first level, it may be relatively easy for the instrument to suck the desired portion of the sample into the nozzle. However, if the sample within the tube were at the second level, then it may be relatively less easy for the instrument to suck the desired portion of the sample into the nozzle. Therefore, there is a need to provide a way by which sample present at the second level may be more easily sucked into the nozzle.

SUMMARY

Embodiments of a container for holding an item are disclosed. In one embodiment, the container comprises an open end, a closed end and a shank connecting the open end with the closed end. A flange extends from the open end. The flange has a configuration which supports the container in an intended relationship with respect to a relatively large tube, a relatively small tube or a carrier.

DETAILED DESCRIPTION OF ILLUSTRATED EMBODIMENTS

Figure 1:
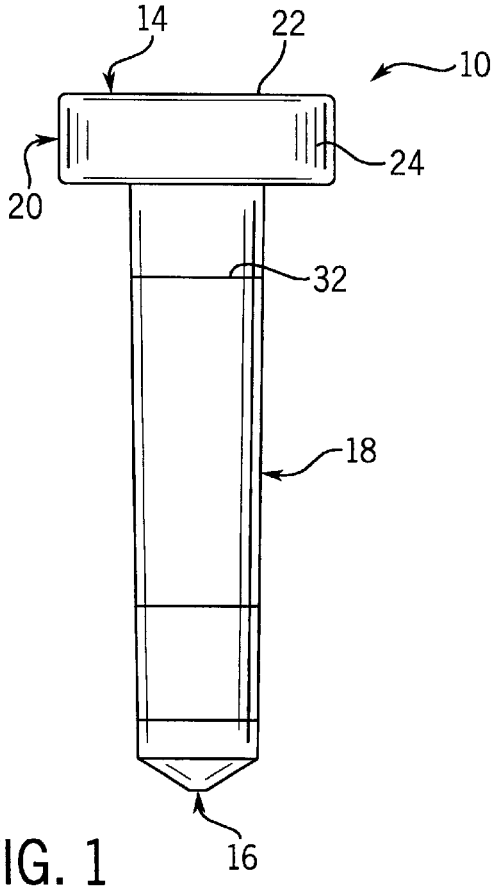
FIG. 1 is a side view of one embodiment of a container described herein.
Figure 2:
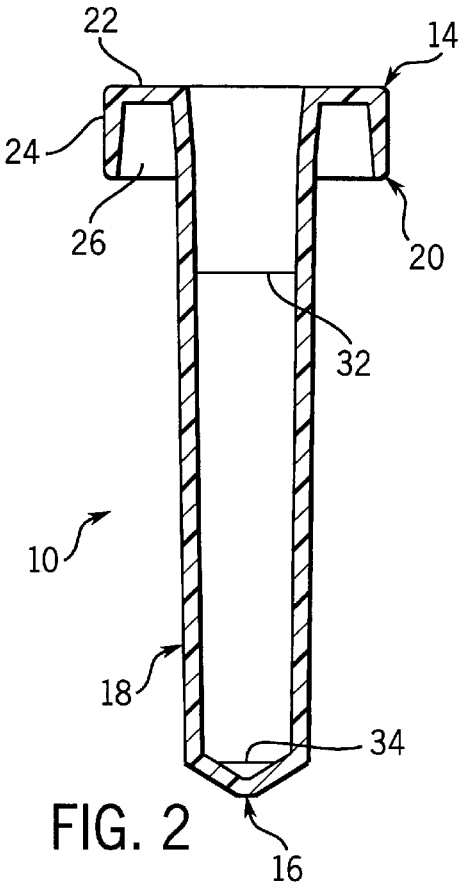
FIG. 2 is a side sectional view of the container of FIG. 1.
Figure 3:
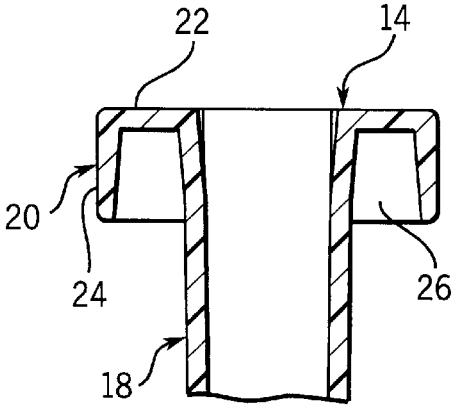
FIG. 3 is an enlarged sectional view of a portion of the container of FIG. 2.
Figure 4:
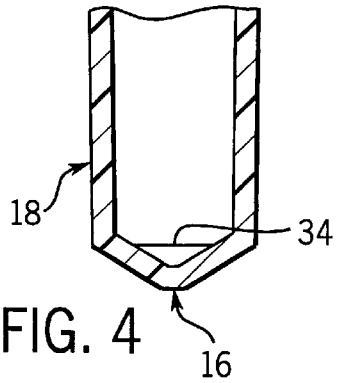
FIG. 4 is an enlarged sectional view of another portion of the container of FIG. 2.
Figure 5:
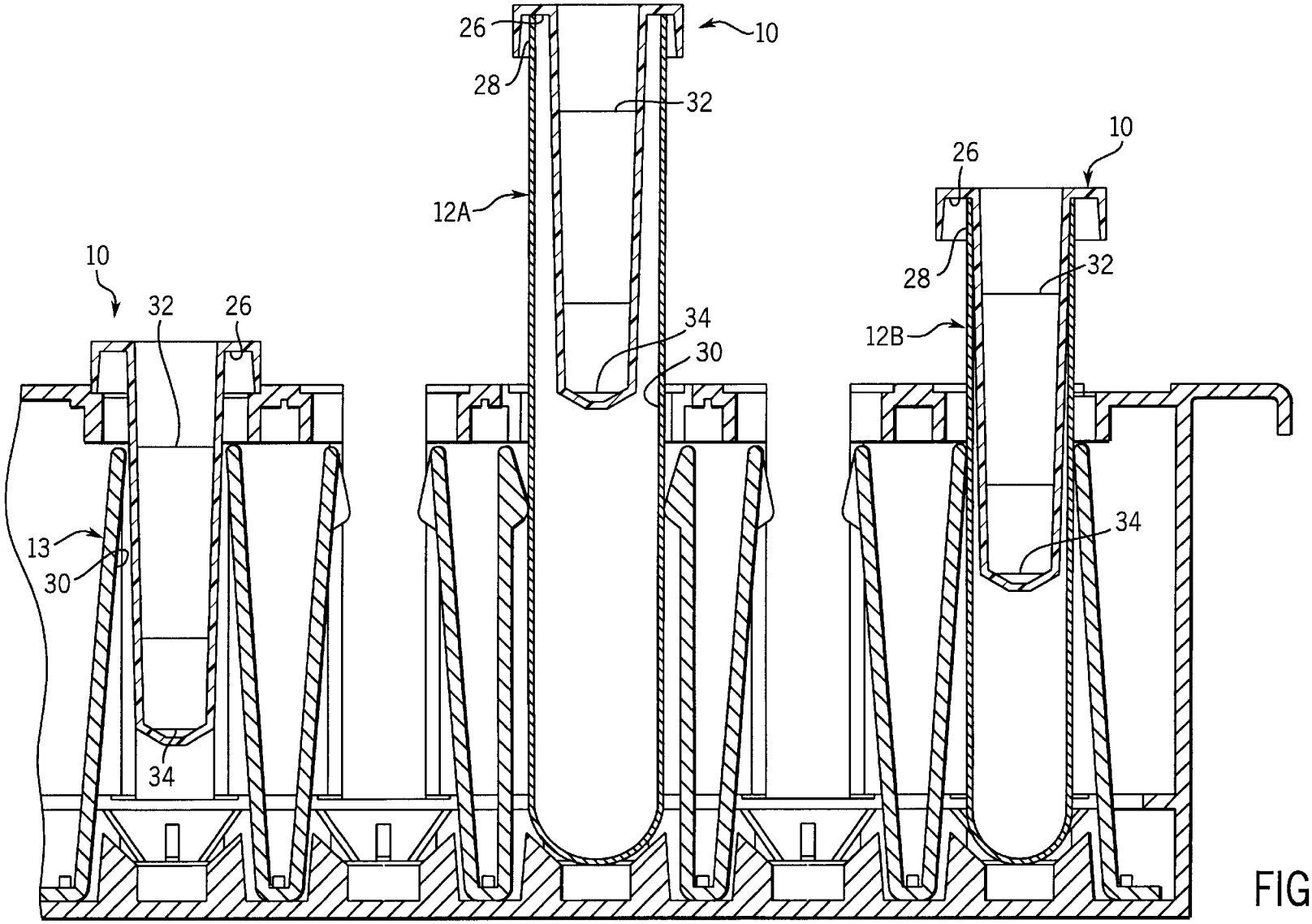
FIG. 5 is a sectional view illustrating a few employments of the container of FIG. 1.

The Figures illustrate an exemplary embodiment of a container 10, which may be used to facilitate access of an item, such as a blood sample and the like, along with a few employments of the container 10. It is to be remembered that while a particular embodiment and particular employments of the container 10 are described herein to facilitate understanding, other embodiments and employments are also possible. For instance, while it is currently contemplated that the container 10 may be used with a plurality of tubes, such as a relatively large tube 12A (e.g. a 16 mm tube) and a relatively small tube 12B (e.g. a 13 mm tube) (FIG. 5), it is possible that the container 10 may be used with other tubes, thereby possibly requiring modification of an element of the container 10 to facilitate that use. Also, as shown in FIG. 5, the container 10 may be used without a tube 12A and 12B and may be placed directly on a carrier 13, such as a tube rack and the like. Accordingly, certain structures of the container 10 may be changed to facilitate use with a carrier 13 of a different construction.

FIGS. 1 through 4 show a particular embodiment of the container 10. The container 10 comprises an open end 14 and a closed end 16 joined by a shank 18. The open end 14 is substantially circular and includes a flange 20 made up of a first portion 22 and a second portion 24. The flange 20 is substantially annular and extends from an outer diameter of the open end 14. The flange 20 has a configuration which supports the container 10 in an intended relationship with respect to the tube 12A or 12B.

Specifically, the first portion 22 projects substantially orthogonally from the shank 18 adjacent the open end 14 by a distance proportional to an outer diameter of an open end of the tube 12A and 12B. The distance is predetermined such that the distance is sufficient to allow the flange 20 to support the container 10 in appropriate, intended relationship with respect to, e.g. on top of, a tube 12A or 12B as shown in FIG. 5. Thus, the distance may be predetermined such that the container 10 may be used with a selected variety of tubes 12A and 12B having various features, such as different outer diameters and the like. Also, the distance may be predetermined such that the container 10 may be used with a selected variety of carriers 13.

The second portion 24 is located at an end of the first portion 22 opposite to another end of the first portion 22 which is attached to the shank 18. The second portion 24 is oriented substantially orthogonally to the first portion 22 such that the second portion 24 extends substantially parallelly to the shank 18. Along with the shank 18 and the first portion 22, the second portion 24 defines a trough 26 for accepting a portion 28 (FIG. 5) of the tubes 12A and 12B adjacent the open ends of the tubes 12A and 12B. The trough 26 is constructed such that, when the container 10 is inserted into the open ends of the tubes 12A and 12B, the container 10 can rest on the open ends of the tubes 12A and 12B, thereby providing more easy access to the item (e.g. sample), as will be described in greater detail later. Furthermore, the shank 18, the first portion 22 and the second portion 24 are configured such that the container 10 can be positioned within a receptacle 30 on the carrier 13 (FIG. 5).

The shank 18 is substantially cylindrical and defines a volume for accepting sample. An outer profile of the shank 18 may be tapered to facilitate insertion of the container 10 into the open ends of the tubes 12A and 12B. The shank 18 extends between the open end 14 and the closed end 16 of the container 10 by a distance predetermined to locate a level of sample within the container 10 at a position where the sample may be more easily accessed. In the illustrated embodiment, the shank 18 is constructed such that a volume of about 1.3 ml of sample reaches level 32 within the container 10. Reference to FIG. 5 clearly shows that the level 32 of sample within the container 10 is elevated with respect to a corresponding level of the same volume of sample within the tubes 12A and 12B. Therefore, for a given volume of sample, it would be easier to access that sample from the container 10 than from either of the tubes 12A and 12B.

An interior profile of the closed end 16 of the container 10 is sloped. With this construction, a volume located at the closed end 16 to a level 34 in the container 10 is about 25 μl. This volume may be relatively difficult to access and may be considered to be "dead volume."

To provide greater understanding of the container 10, the following exemplary dimensions and materials are provided. It is to be remembered that these dimensions and materials may be modified as desired.

The container 10 may be made from any suitable material, such as a polymer and the like. Some suitable polymers are polystyrenes, such as DOW 666DW (Dow Chemical of Midland, Mich.). The material may be selected such that the material does not adversely interact with the item to be disposed in the container 10, such that the material is not adversely effected by the expected environment of use, etc.

In one embodiment, the container 10 has a surface finish of SP1-A-3 on all surfaces. Walls comprising the container 10 may be about 0.032 inches thick. The container 10 is dimensioned such that the container's 10 axial length is no longer than about 1.955 inches and some corners have a radius of about 0.005 inches. The open end 14 of the container 10 defines a diameter of about 0.372 inches.

The flange 20 defines a diameter of about 0.78 inches with the second portion 24 extending from the first portion 22 by a distance measuring about 0.216 inches. An upper corner of the first portion 22 adjacent to the shank 18 defines a radius of about 0.01 inches while the associated lower corner defines a radius of about 0.005 inches. A juncture between the first portion 22 and the shank 18 defines a diameter of about 0.432 inches while a juncture between the first portion 22 and the second portion 24 defines a diameter of about 0.69 inches. An upper corner of the first portion 22 adjacent the second portion 24 defines a radius of about 0.015 inches while the associated lower corner defines a radius of about 0.01 inches. Depending ends of the second portion 24 define a radius of about 0.01 inches. A distance between an underside of the first portion 22 and the level 32 measures about 0.463 inches, between the underside of the first portion 22 and the level 34 measures about 1.815 inches, between underside of the first portion 22 and an interior of the closed end 16 measures about 1.865 inches, and between underside of the first portion 22 and a terminal exterior of the closed end 16 measures about 1.893 inches.

The shank 18 is tapered such that, adjacent depending ends of the second portion 24, an interior diameter of the shank 18 measures about 0.338 inches. An outer diameter of the shank 18 above the level 32 measures about 0.4 inches, and below the level 32, the outer diameter of the shank 18 measures about 0.388 inches. At a distance of about 1.378 inches from an underside of the first portion 22, the outer diameter of the shank 18 changes from about 0.382 inches to about 0.372 inches. At a distance of about 1.699 inches from an underside of the first portion 22, the outer diameter of the shank 18 changes from about 0.369 inches to about 0.359 inches, and at a distance of about 1.815 inches from an underside of the first portion 22, the outer diameter of the shank 18 changes from about 0.359 inches to about 0.351 inches.

At the closed end 16, the shank 18 is sloped at an angle measuring about 30 degrees at a radius measuring about 0.075 inches while the inner portion of the closed end 16 defines a radius measuring about 0.05 inches. A substantially planar tip of the closed end 16 defines a diameter of about 0.059 inches.

With construction of the container 10 being thusly described, some exemplary employments of the container 10 will now be disclosed. Other employments are also possible.

Sample is obtained from a patient and is retained in one of the tubes 12A and 12B. Of course, it is assumed that the first level of sample within the tubes 12A and 12B renders the sample relatively difficult to access. The tubes 12A and 12B may include a stopper or other structure for limiting loss of sample from the tubes 12A and 12B. When it is desired to access the sample, such as for performing a medical test or the like on the sample, the stopper, if present, is removed and the sample is transferred from the tube 12A and/or 12B to the container 10. This transfer may be by pouring the sample from the tube 12A or 12B into the container 10, by manual or automatic pipetting, or any suitable technique.

With the sample now in the container 10, the level 32 of sample is sufficient to make the sample relatively easy to access. If desired, the container 10 may be placed directly in a receptacle 30 on the carrier 13 (left hand side, as viewed, of FIG. 5). Alternatively, the tube 12A or 12B from which the sample was transferred, or another tube 12A or 12B, may be placed in the receptacle 30 on the carrier 13 first. Then, the container 10 may be placed in the tubes 12A or 12B. Specifically, the closed end 16 of the container 10 is inserted into the open end of the tube 12A or 12B. The container 10 is moved with respect to the tube 12A or 12B such that the first portion 22 of the flange 20 approaches the open end of the tube 12A or 12B. The first portion 22 engages and rests upon the open end of the tube 12A and 12B. Of course, the container 10 may be placed in the tube 12A or 12B prior to location of the tube 12A or 12B within the receptacle 30.

What is claimed is:

1. In a sample container for holding a patient sample, for access by an automated instrument, the sample container including an open end, a closed end, and a shank connecting the open end with the closed end, the shank having dimensions for holding a desired volume of the patient sample transferred from a relatively large tube having an opening with a first outer diameter surface or a relatively small tube having an opening with a second outer diameter surface used to collect the patient sample from the patient, the second outer diameter being smaller than the first outer diameter, the improvement comprising:

(a) a flange extending from the open end, the flange having a configuration which supports the sample container in an intended relationship with respect to the relatively large tube, the relatively small tube or a carrier so that the desired volume of the patient sample can be accessed by the automated instrument, the flange including (i) a first portion extending substantially orthogonally from the shank, and (ii) a second portion extending substantially orthogonally from the first portion, the first portion having a first end connected with the shank and a second end connected to the second portion; and (b) a trough defined by the flange being dimensioned such that the first portion rests on the opening of the relatively large tube or the opening of the relatively small tube such that either the first outer diameter surface or the second outer diameter surface is located within the trough between the shank and the second portion.

* * * * *